US006216651B1

(12) United States Patent
Ishikawa et al.

(10) Patent No.: US 6,216,651 B1
(45) Date of Patent: Apr. 17, 2001

(54) SEPARATE LUBRICATING DEVICE FOR INTERNAL COMBUSTION ENGINE

(75) Inventors: Takeshi Ishikawa; Tadashige Kondo, both of Tokyo (JP)

(73) Assignee: Kioritz Corporation, Tokyo (JP)

( * ) Notice: Subject to any disclaimer, the term of this patent is extended or adjusted under 35 U.S.C. 154(b) by 0 days.

(21) Appl. No.: 09/302,782

(22) Filed: Apr. 30, 1999

(30) Foreign Application Priority Data

May 14, 1998 (JP) ..... 10-131726

(51) Int. Cl.[7] ..... F02B 33/04

(52) U.S. Cl. ..... 123/73 AD; 123/73 C; 123/298; 123/196 AB

(58) Field of Search ..... 123/73 A, 73 AD, 123/196 AB, 298, 73 C, 297

(56) References Cited

U.S. PATENT DOCUMENTS

| | | | | |
|---|---|---|---|---|
| 4,779,581 | * | 10/1988 | Maier | 123/73 A |
| 4,930,462 | | 6/1990 | Kamata . | |
| 4,967,700 | * | 11/1990 | Torigai | 123/73 AD |
| 5,020,484 | * | 6/1991 | Ishikawa et al. | 123/73 AD |
| 5,191,531 | * | 3/1993 | Kurosu et al. | 701/103 |
| 5,315,971 | * | 5/1994 | Yamada | 123/196 R |
| 5,370,089 | * | 12/1994 | Harada | 123/73 AD |
| 5,390,635 | * | 2/1995 | Kidera et al. | 123/196 R |
| 5,511,524 | * | 4/1996 | Kidera et al. | 123/196 R |
| 5,522,370 | * | 6/1996 | Katoh et al. | 123/685 |
| 5,555,858 | * | 9/1996 | Katoh | 123/73 SC |
| 5,597,051 | * | 1/1997 | Moriya et al. | 184/6.1 |
| 5,690,063 | * | 11/1997 | Motoyama et al. | 123/73 A |
| 5,701,856 | * | 12/1997 | Nagano et al. | 123/73 AD |
| 5,894,832 | * | 4/1999 | Nogi et al. | 123/491 |
| 5,934,257 | * | 8/1999 | Ishikawa et al. | 123/481 |
| 5,941,210 | * | 8/1999 | Hill et al. | 123/305 |
| 6,047,671 | * | 4/2000 | Tubb et al. | 123/73 AD |
| 6,062,202 | * | 5/2000 | Chasteen | 123/478 |

FOREIGN PATENT DOCUMENTS

| | | |
|---|---|---|
| 1113510 | 5/1989 | (JP) . |
| 1037730 | 2/1998 | (JP) . |

* cited by examiner

*Primary Examiner*—Willis R. Wolfe
*Assistant Examiner*—Hai Huynh
(74) *Attorney, Agent, or Firm*—Baker Botts L.L.P.

(57) ABSTRACT

A separate lubricating device for a two-stroke internal combustion engine provided with an air intake system and a controlling device includes an injector for injecting lubricating oil into a passage of the air intake system and a lubricating control device associated with the controlling device. The lubricating control device controls the timing and quantity of injection of the lubricating oil into the engine.

13 Claims, 5 Drawing Sheets

Discharging
Pause

P
360°
Angle of crankshaft

P
360°
Angle of crankshaft

P
360°
Angle of crankshaft

SEPARATE LUBRICATING DEVICE FOR INTERNAL COMBUSTION ENGINE

BACKGROUND OF THE INVENTION

The present invention relates to a separate lubricating device for an internal combustion engine, and in particular to a separate lubricating device for supplying a lubricating oil by means of an electronic control to an internal combustion engine, such as a relatively small two-stroke internal combustion engine which is suited for use in a portable working machine, for example, a chain saw, a bush cutter, or the like.

There have been previously known two different systems for supplying lubricating oil to a two-stroke internal combustion engine, namely: a mixture method lubrication system, which is widely employed, wherein lubricating oil is mixed in advance with fuel such that a mixture of fuel and lubricating oil is supplied to the engine intake; and a separate lubricating system, wherein a lubricating oil is supplied mechanically to the engine by a lubricating oil pump. Examples of separate lubricating systems are disclosed in, for example, Japanese Patent Unexamined Publication H1-113510; and Japanese Utility Model Unexamined Publication H2-13111.

The aforementioned mixture method lubrication system is designed to supply a lubricating oil at a predetermined mixing ratio, which is usually established to conform with the quantity of lubricating oil required for a high revolution speed of engine. It is difficult to adjust the quantity of lubricating oil to an optimum degree for low speed operation of the engine, thus causing problems such as the generation of smoke or offensive odor at low engine speeds or at idling of the engine.

On the other hand, with a conventional separate lubricating system, the lubricating oil pump is driven by motive power derived from a crankshaft, thereby to enable an optimum quantity of lubricating oil to be supplied from the discharge port of the pump to the internal combustion engine in conformity with the revolution speed of the engine. However, there is a problem that a fine control of supply of lubricating oil cannot be achieved by only controlling the revolution speed of the pump.

Furthermore, with the previously known apparatus for mechanically supplying lubricating oil, since the lubricating oil pump is driven by making use of the driving force of the engine, the pumping efficiency of the lubricating oil pump is caused to decrease as the revolution speed of the engine becomes higher, thus raising a problem that it becomes impossible to supply a sufficient quantity of lubricating oil which is necessary for a high revolution speed of engine.

BRIEF SUMMARY OF THE INVENTION

The present invention has been made under the aforementioned circumstances, and therefore an object of the present invention is to provide a separate lubricating device for a two-stroke internal combustion engine, which is capable of controlling the quantity or time of lubricating oil to be fed to the engine based on the operating conditions of the engine, thereby always enabling an optimum quantity of lubricating oil to be supplied with fine control.

With a view to attaining the aforementioned object, the present invention provides a separate lubricating device for a two-stroke internal combustion engine having an air intake system and a controlling device. The invention is characterized in that it comprises an injector for injecting lubricating oil into a passage of the air intake system and a lubricating control device associated with the controlling device and in that the lubricating control device controls so either the timing of the supply of lubricating oil from the injector or the quantity of lubricating oil injected into the engine by the injector. Preferably, the lubricating control device controls both the timing of the injections of lubricating oil from the injector and the quantity of lubricating oil injected upon each injection by the injector.

In a preferred embodiment of the separate lubricating device for a two-stroke internal combustion engine according to the present invention, the injector is provided with a heating element for heating the lubricating oil.

The lubricating control device may be provided with an injection mode-controlling means which is capable of transforming DC power into a sequential rectangular pulse wave and of varying the number of outputs of the pulse wave to the injector, thereby to control the time intervals of injection. The injection mode-controlling means provides for selectively switching from an output to the injector of every pulse of the pulse wave to an output to the injector of one pulse out of each consecutive sequence of a selected number of two or more pulses of the pulse wave, such as one out of every two pulses or one out of every three pulses.

In other embodiments of the separate lubricating device according to the present invention, the lubricating control device includes means for controlling the quantity of lubricating oil injected into the engine from the injector upon each injection by the injector. The quantity of lubricating oil injected by the injector may be controlled in response to a signal indicative of the engine load, such as a signal indicative of the revolution speed of the internal combustion engine.

Since lubricating oil is supplied by an electronically controlled injector in the separate lubricating device for a two-stroke internal combustion engine according to the present invention, it is possible to supply the engine with a precisely controlled quantity of lubricating oil, i.e. a larger quantity at high revolution speed of the engine and a smaller quantity at low revolution speed of the engine. Therefore, it becomes possible now to provide a finer control of the supply of lubricating oil as compared with the conventional mechanical pumping system. Further, since the consumption of lubricating oil can be reduced at a low revolution speed, it is possible to produce a two-stroke internal combustion engine which is capable of inhibiting the generation of smoke or offensive odor, thus protecting the environment.

DESCRIPTION OF THE DRAWINGS

FIG. 4 generally shows examples of the lubricating oil injection-time interval mode of operation of the internal combustion engine shown in FIG. 3, wherein

DESCRIPTION OF THE EMBODIMENT

Figure 1:
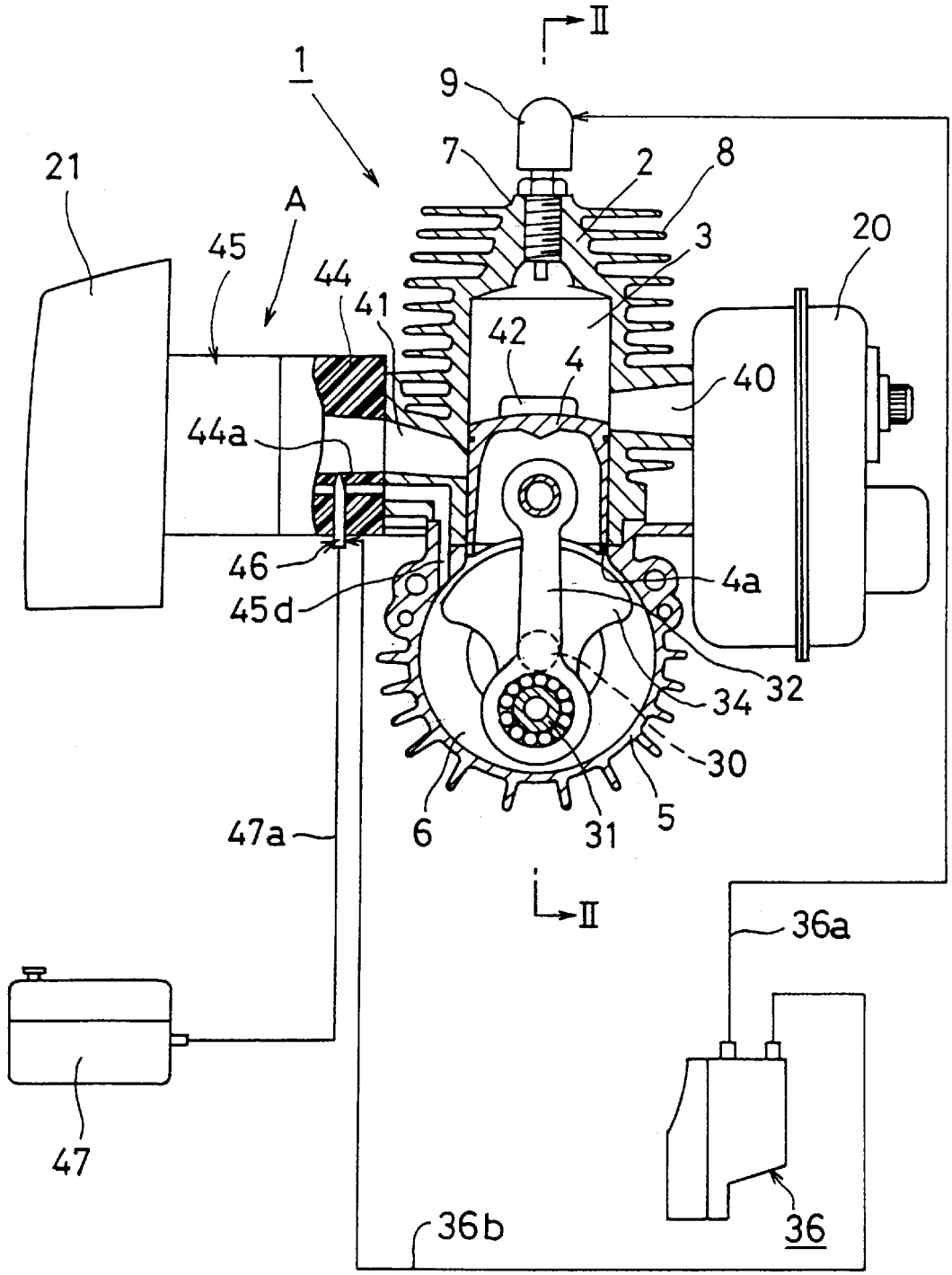
FIG. 1 is a longitudinal cross-sectional view of an engine that is equipped with an embodiment of a separate lubricating device for an internal combustion engine according to the present invention.
Figure 2:
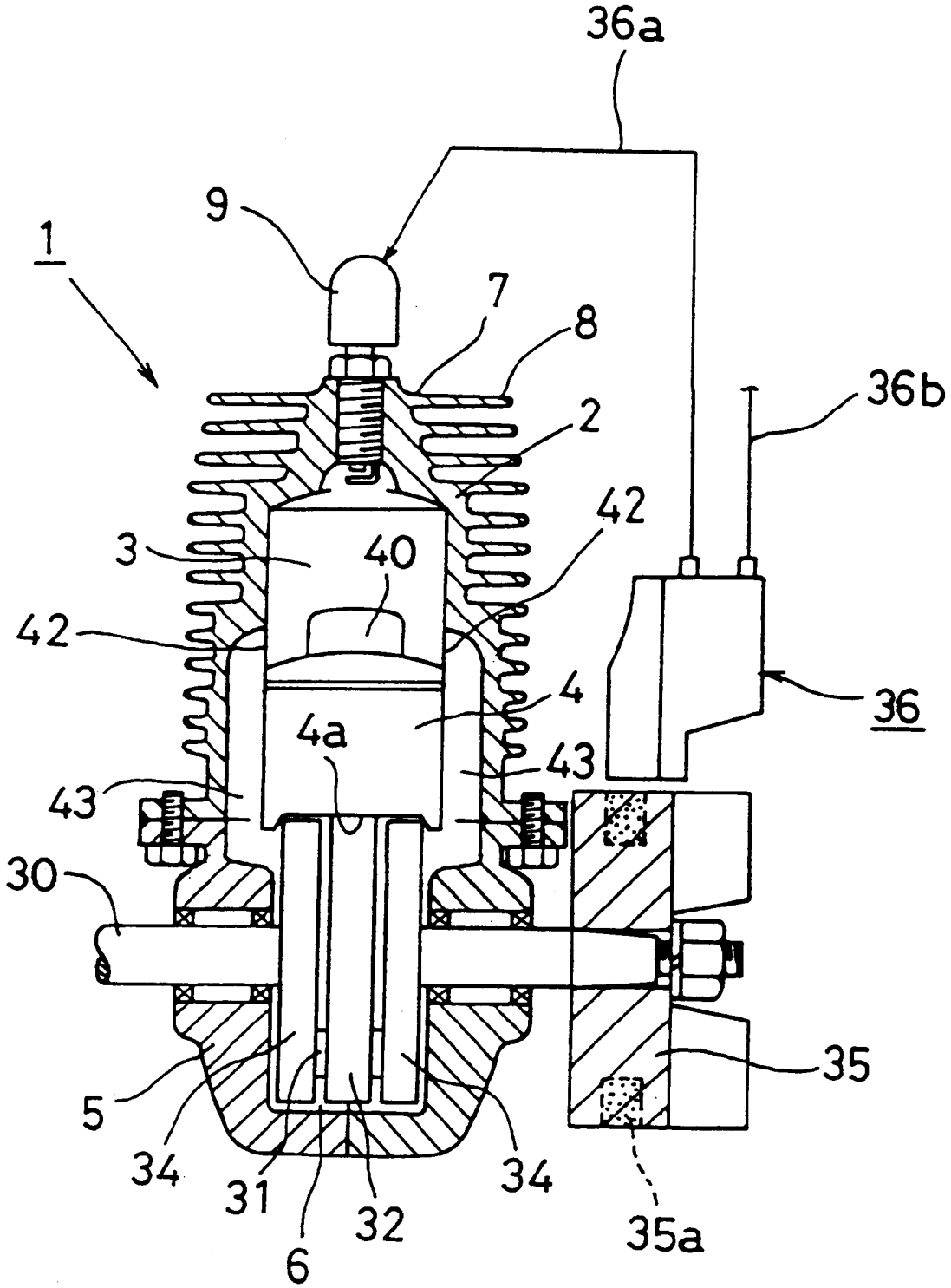
FIG. 2 is a cross-sectional view taken along the line II—II of the internal combustion engine shown in FIG. 1.

Referring to FIGS. 1 and 2, the internal combustion engine 1 is an air-cooled two-stroke gasoline engine of so-called Schnuerle type crankcase pre-compression system. Specifically, the internal combustion engine 1 comprises a cylinder block 2 having a cylinder chamber 3 into which a piston 4 is slidably inserted so as to enable the piston 4 to be moved up and down, a crankcase 6 of a split type connected with the bottom portion of the cylinder block 2, and a cylinder head 7 formed integrally with the upper portion of the cylinder block 2. A large number of air-cooling fins 8 are formed on the outer peripheral wall of the internal combustion engine 1, and an ignition plug 9 is mounted on a suitable position in the cylinder head 7.

The crankcase 6 is of a closed short cylindrical configuration in which a crankshaft 30 is axially supported in coaxial relation with the central portions of the right and left ends of the crankcase 6. The crankshaft 30 is provided with a crank pin 31 to which the piston 4 is pivotally connected through a connecting rod 32. A pair of sector-shaped crank webs 34 are respectively secured to the left and right ends of the crank pin 31 with the connecting rod 32 being interposed between the pair of sector-shaped crank webs 34. Therefore, the pair of sector-shaped crank webs 34 are arranged to rotate conjointly with the crankshaft 30.

An air cooling fan-attached rotor 35, in which magnets 35*a* are embedded, is affixed to one end of the crankshaft 30. An internal combustion engine-controlling device 36 (see FIG. 3, which is described in detail hereinafter), in which an ignition control device 37 and a lubricating control device 39 are integrally incorporated, is disposed to face the outer peripheral surface of the rotor 35. The output power from the internal combustion engine-controlling device 36 is conducted by a first conductor wire 36*a* to the ignition plug 9 as well as by a second conductor wire 36*b* to an injector 46 (explained in detail hereinafter).

The cylinder block 2 is provided with an exhaust port 40 opening at a portion of the internal wall surface of the cylinder chamber 3, which is oriented to orthogonally intersect with the axis of the crankshaft 30. The cylinder block 2 is further provided with an intake port 41 opened at a portion of the internal wall surface of the cylinder chamber 3, which faces the portion of the internal wall surface of the cylinder chamber 3 where the exhaust port 40 is opened (i.e. a position which is spaced apart by an angle of 180 degrees), the intake port 41 being, however, disposed at a lower level than that of the exhaust port 40. Additionally, a pair of scavenging ports 42 are respectively opened at the portions of the internal wall surface of the cylinder chamber 3, which are displaced from the exhaust port 40 and also from the intake port 41 by an angle of 90 degrees (the right and left sides of FIG. 2) so that the openings of the pair of scavenging ports 42 face to each other. The pair of scavenging ports 42 are formed, respectively, at the upper ends of the scavenging passages 43, each extending to a lower portion of the cylinder block 2 and communicating with the crank chamber 6.

An air intake system "A" located on the intake port 41 side of the engine 1 is connected, with a heat insulator 44 interposed, with a carburetor 45. Further, an air cleaner 21 is mounted on the air inflow side or upstream side of the carburetor 45.

To the heat insulator 44 is attached a lubricating oil injector 46, which is directed to a passage 44*a* formed in the heat insulator 44. Lubricating oil is fed to the injector 46 by a suitable feeding means (not shown) and a pipe 47*a* from an oil tank 47, and is injected, while being controlled by means of the lubricating control device 39 of the control device 36 of the engine 1 as hereinafter explained, into the interior of the passage 44*a*.

Figure 3:
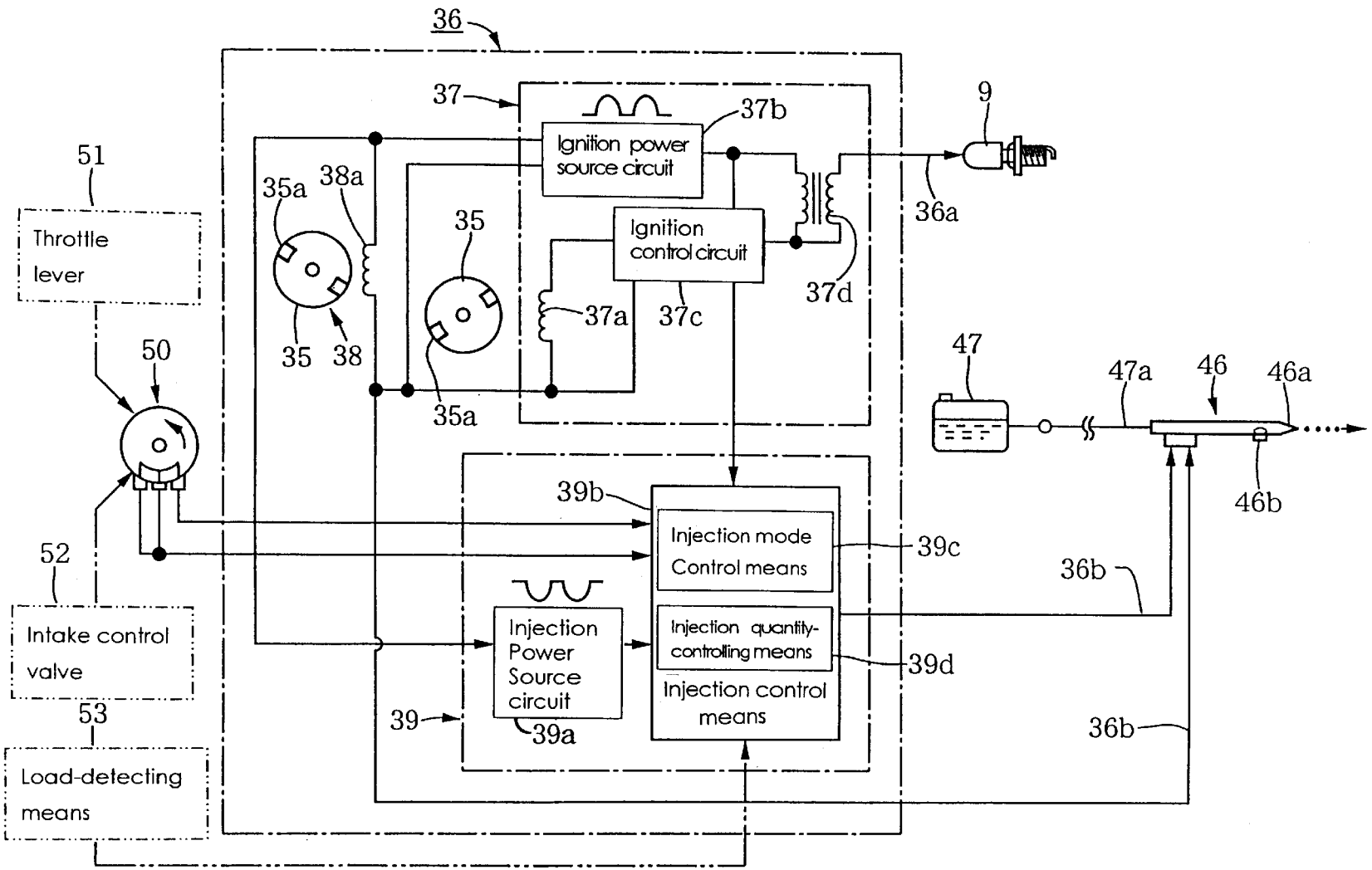
FIG. 3 is a wiring diagram, illustrating the function of the internal combustion engine shown in FIG. 1.

FIG. 3 is a wiring diagram, illustrating the internal structure of the control device 36 according to the embodiment and the relationship between the ignition plug 9 and the injector 46, which are actuated by the control device 36.

Specifically, the control device 36 is constituted generally by an integrated body comprising an ignition control device 37 of an electronic system such as a CDI system or a TCI system, an AC power generation device 38, and the lubricating control device 39. The AC power generation device 38 generates electric power through the rotation of the cooling fan-attached rotor 35, thereby to supply electric power to the ignition control device 37 as well as to the lubricating control device 39, thus actuating the ignition plug 9 and the injector 46.

The ignition control device 37 is of a conventional design that comprises a pick-up coil 37 *a* for controlling the ignition timing, an ignition power source circuit 37 *b* for performing a half-wave rectification of AC power fed from the power generating device 38, an ignition control circuit 37*c,* an ignition coil 37*d,* etc.

The lubricating control device 39 comprises an injection power source circuit 39*a* for performing a half-wave rectification, which is opposite in phase to that of the ignition power source circuit 37 *b*, and a lubricating oil control means (circuit) 39*b* for controlling the injection of lubricating oil. The lubricating oil control circuit 39*b* is provided with an injection mode control means 39*c* for controlling the timing of injections of lubricating oil and an injection quantity-controlling means 39*d* for controlling the quantity of lubricating oil injected each time the injector 46 is actuated.

The ignition control device 37 is connected by a high voltage cord (the first conductor wire) 36*a* to the ignition plug 9, while the lubricating control device 39 is connected by the second conductor wire 36*b* to the injector 46.

Although the ignition control device 37 is designed to perform the ignition thereof by making use of an AC electromotive force generated by the AC power generation means 38, the actual electromotive force used for the ignition is a half-wave voltage of either the plus or minus side of the generated voltage, so that the other side of half-wave voltage is not utilized for ignition. According to the embodiment, a half-wave voltage of the side which is not utilized for ignition is utilized to actuate the injector 46.

More specifically, the AC power generation means 38 is designed to generate an AC electromotive power through the rotation of the cooling fan-attached rotor 35, thereby enabling an ignition to be effected at the moment when the voltage changes from the plus side (or minus side) to the minus side (or plus side) on the basis of the voltage of the plus side (or minus side). In this case, the injector 46 is actuated as follows. First of all, in order to utilize an AC electromotive power of the minus side (or plus side) which is opposite to that utilized for the aforementioned ignition, the aforementioned AC electromotive power is picked up from the ignition control device 37 and fed to the lubricating control device 39, and then the heating element 46*b* of the injector 46 is instantaneously heated by taking advantage of the electric voltage of the minus side (or the plus side) which is opposite to that utilized in the ignition control device 37, thereby causing lubricating oil to be injected from the nozzle end 46*a* of the injector 46.

AC power generated by the AC power generation means 38 is delivered by a power generation coil 38*a* to the lubricating control device 39 so as to be converted into a DC current through the half-wave rectification thereof by the injection power source circuit 39*a,* and at the same time, the aforementioned AC power is fed to the lubricating oil control means 39*b*. The lubricating oil control means 39*b* is designed to output DC power, based on an output signal from the ignition control circuit 37*c* of the ignition control device 37, to the heating element 46*b,* thereby instantaneously heating the heating element 46*b* at a high voltage, thereby causing lubricating oil to be injected into the passage 44*a* from the nozzle end 46*a* of the injector 46.

Further, the injection mode control means 39*c* shown in FIG. 3 is designed to transform the aforementioned DC power into a sequential rectangular pulse wave "P" by means of a pulse generator, etc. and at the same time, to control the output interval of the pulse wave "P", thereby to control the injection interval (injection mode).

Figures 4A, 4B, 4C:
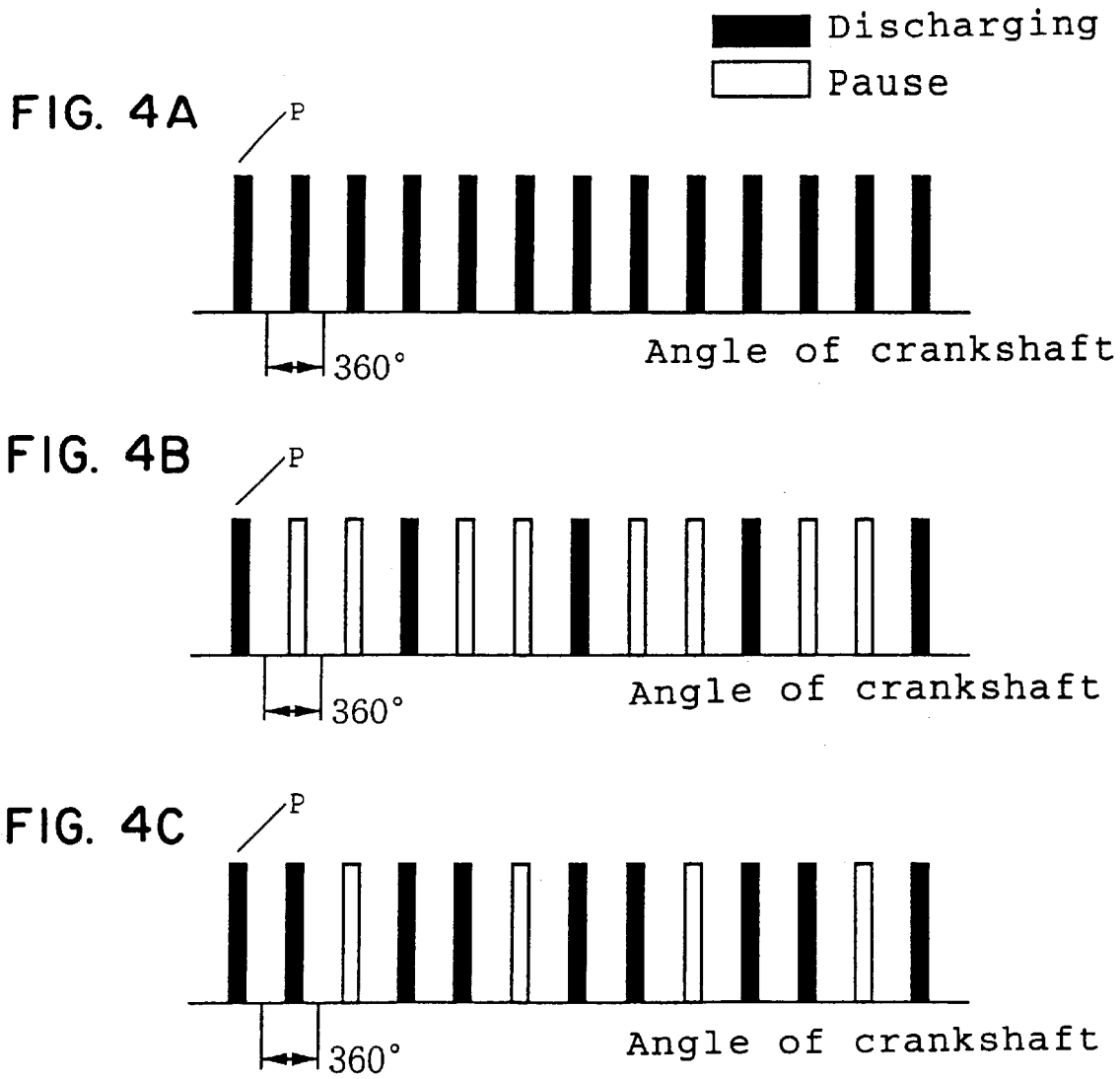
FIG. 4A represents a continuous discharging, and both
FIGS. 4B and 4C represent a thinned-out discharging.

As for the specific type of control of the injection mode control means 39*c*, it may be a continuous injection mode wherein the lubricating oil from the injector 46 is injected at every pulse of the aforementioned pulse wave "P" (see FIG. 4A), or it may be an intermittent injection mode wherein the output of the pulse wave "P" occurs on every other pulse of the wave "P", thereby causing the lubricating oil to be injected once per every two pulses of the pulse wave "P" (see FIG. 4C). Alternatively, the specific type of control of the injection mode control means 39*c* may be a "thinned-out" injection mode wherein the output of the pulse wave "P" occurs on one out of every three pulses, pausing for two sequential pulses out of every sequential three pulses, thereby causing the lubricating oil to be injected once per every three pulses of the pulse wave "P" (see FIG. 4B).

Figure 5:
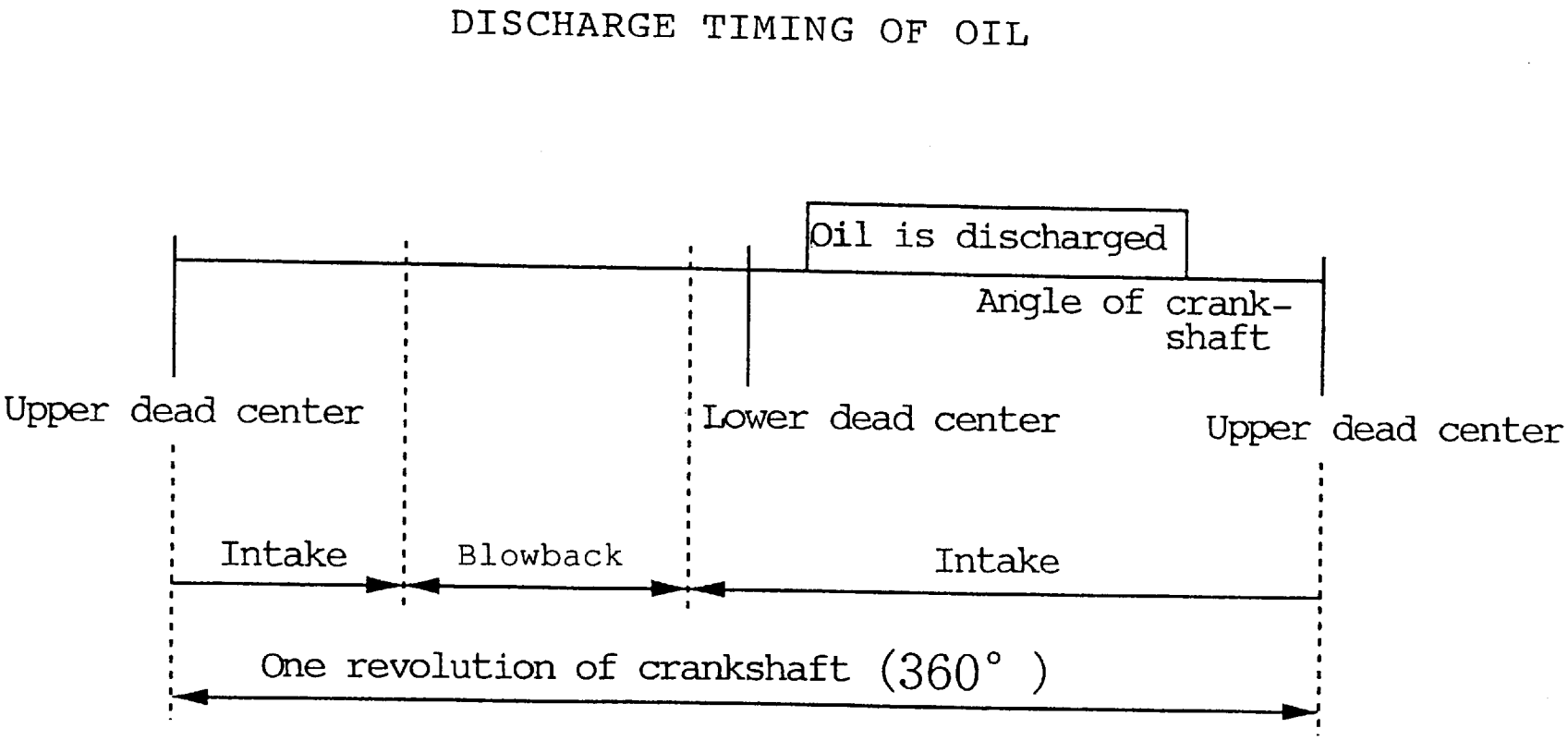
FIG. 5 is a diagram showing the relationship between the rotation of a crankshaft and the timing of the discharge of lubricating oil from the injector.

As shown in FIG. 5, in order to prevent the "blowback" of the lubricating oil due to a back pressure from the cylinder chamber 3 side to the intake side (air cleaner 21), it is also possible to adopt a mode wherein the output of the pulse wave is suspended so as to interrupt the injection of lubricating oil during the back-flow period beginning from the cylinder chamber 3 side up to the intake side (a predetermined period before the lower dead center of the piston 4) within each stroke of the internal combustion engine 1.

The injection mode control means 39*c* may, optionally, also be arranged to be actuated based on the detection of variations of various other conditions associated with the operating state of the engine 1. For example, as shown in FIG. 3, an angle sensor 50 functioning as a detecting means, such as a potentiometer, a rotary switch, or the like, may be mounted on the throttle lever 51 or intake control valve 52 of the internal combustion engine 1, thereby enabling the injection mode control means 39*c* to be actuated so as to change the injection mode on the basis of the angle signal of the angle sensor 50. Furthermore, the movement of the throttle lever 51 for operating the intake control valve 52 of the internal combustion engine 1 may be detected by means of the angle sensor 50, thereby making it possible to convert the injection mode from the injection per pulse wave mode to the thinned-out injection mode, and vice versa, by changing the position of actuation (by changing the opening degree of the intake control valve 52).

The injection quantity-controlling means 39*d* is designed to control the injection quantity of lubricating oil in each injection of lubricating oil from the injector 46. In particular, the degree of heating of the heating element 46*b* is controlled by the injection quantity-controlling means 39*d* so as to adjust the quantity of lubricating oil injected from the injector 46. In other words, the quantity of lubricating oil to be injected from the injector 46 is varied in accordance with the output signal of the load-detecting means 53, which detects the variation in load of the engine 1, as indicated, for example, by the revolution speed of the internal combustion engine 1 or the seat temperature of the ignition plug 9. Another way of adjusting the quantity of lubricating oil is to arrange a plurality of injection nozzle ends 46*a* of the injector 46 and to suitably select any injection nozzle ends 46*a* according to a given difference in the operation conditions, thereby allowing the lubricating oil to be injected from the selected injection nozzle portions 46*a*.

The operation of the separate lubricating device of the internal combustion engine constructed according to the embodiment will now be explained.

The internal combustion engine 1 according to the embodiment which is shown in FIGS. 1 and 2 is of so-called piston valve system, wherein neither an intake valve nor an exhaust valve are provided, but simply the piston 4 is slidably moved up and down, thereby allowing the intake port 41 or the exhaust port 40 to be opened to or communicated with the crankcase 6 or the cylinder chamber 3 so as to perform the intake or exhaust of the engine, i.e. the same functions as those performed by an intake valve and an exhaust valve.

When the internal combustion engine 1 is running and the piston 4 is moving up and down, outside air is allowed to enter from the air cleaner 21 and to pass through the carbureter 45 into the intake port 41. The heating element (not shown in FIG. 2) of the injector 46 is heated based on the output signal (pulse signal) from the lubricating oil control means 39*b* of the control device 36 so as to cause lubricating oil to be injected intermittently from the injection nozzle end 46*a* of the injector 46 into the passage 44*a* of the heat insulator 44. As a result, the lubricating oil is mixed with the air-fuel mixture inducted into the engine cylinder chamber 3.

When the piston 4 is descending and reaches the vicinity of lower dead center, the exhaust port 40 is opened to the interior of the cylinder chamber 3, thereby allowing the burned exhaust gas in the cylinder chamber 3 to be discharged from the engine 1 to the exhaust muffler 20. Thereafter, the scavenging ports 42 are allowed to open to the cylinder chamber 3. When the scavenging ports 42 are opened in this manner, the air-fuel mixture pre-compressed in the crankcase 6 during the descent of the piston 4 is allowed to enter via the scavenging passageways 43 into the cylinder chamber 3, thereby to purge the residual burnt exhaust gas remaining in the cylinder chamber 3, thus scavenging the cylinder chamber 3. At this point, part of the unburnt air-fuel mixture is also discharged from the exhaust port 40.

While the scavenging operation is occurring, the piston 4 starts to move upwardly again, whereupon the scavenging ports 42 are closed.

Upon further upward movement of the piston 4 after the scavenging ports 42 are closed, the exhaust port 40 is also closed, thereby initiating the compression stroke. When the piston 4 reaches the vicinity of top dead center, high voltage power from the ignition control device 37 of the control device 36 is conducted through the high voltage cord 36*a* to the ignition plug 9. As a result, spark discharge is generated, thereby igniting the compressed air-fuel mixture in the cylinder chamber 3.

When the piston 4 is moving upwardly during the compression stroke, the pressure inside the crankcase 6 is caused to decrease so that when the skirt portion 4*a* of the ascending piston 4 passes over the lower edge of the intake port 41, thereby to allow the intake port 41 to open to the crankcase 6, outside air is immediately inducted and mixed with fuel in the carbureter 45, thus forming air-fuel mixture, which is then inducted into the crankcase 6. At this point, the lubricating oil is also mixed with the air-fuel mixture and inducted into the crankcase 6, thereby lubricating any required portions inside the internal combustion engine 1.

After the air-fuel mixture inside the combustion chamber 3 is ignited and the expansion stroke of the engine 1 begins, the piston 4 begins to descend, thereby to close the intake port 41. As a result, the air-fuel mixture that has been inducted into the crankcase 6 during the previous compression stroke is pre-compressed in the crankcase 6. When the scavenging ports 42 are opened so as to be communicated with the cylinder chamber 3, the inducted air-fuel mixture that has been pre-compressed is allowed to flow, via the scavenging passageways 43, into the cylinder chamber 3 from the scavenging ports 42, thereby beginning another cycle of the operation of the engine 1.

The injection of lubricating oil by the injector 46 is selectively controlled by means of the injection mode control means 39*c* of the lubricating oil control means 39*b* as follows. Based on the output signal from the angle sensor 50, any specific type of injection mode, i.e. (1) an injection-per-pulse mode wherein the lubricating oil from the injector 46 is injected on every pulse of the aforementioned pulse wave "P", (2) an intermittent injection mode wherein the output of the pulse wave "P" is supplied to the injector 46 on alternate pulses, thereby causing the lubricating oil to be injected once per every two pulses of the pulse wave "P", or (3) a thinned-out injection mode wherein the output of the pulse wave "P" is supplied at every third pulse, thereby causing the lubricating oil to be injected once per every three pulses of the pulse wave "P", is selected by the injection mode control means 39*c*, thereby making it possible to feed an optimum quantity of lubricating oil to the engine 1 in conformity with and on the basis of the operating condition of the engine 1.

Likewise, the injection of lubricating oil by the injector 46 is controlled by means of the injection quantity-controlling means 39*d* of the lubricating oil control means 39*b* as follows. Based on various detection signals indicative of the state of operation of the engine 1, such as an output signal from the load detecting means 53 for detecting the revolution speed of the internal combustion engine 1, the injection quantity-controlling means 39*d* controls the output for heating the heating element 46*b* of the injector 46, thereby to control the quantity of lubricating oil injected from the injector 46 upon each injection.

Also, through a complex control of the injection mode control means 39*c* and the injection quantity-controlling means 39*d*, the injection mode of lubricating oil (such as the aforementioned injection per pulse wave mode or thinned-out injection mode) can be suitably combined with injections of an increased or decreased quantity of lubricating oil in each injection, thereby making it possible to control the injection of lubricating oil over a wide range.

In the lubricating control device 39 of the control device 36 according to the embodiment, since it is provided with the injection mode control means 39*c* for controlling the lubricating oil to be injected from the injector 46, it is possible, using the rectangular pulse wave "P" from the electromotive power of the AC power generating means 38, to suitably select the injection mode, such as the injection-per-pulse mode wherein the lubricating oil is injected at every pulse of the pulse wave "P", or various forms of the thinned-out injection modes, to provide optimum lubrication of the engine 1 in accordance with the operating conditions of the engine 1, For example, thinned-out injection during a low revolution speed of the engine 1, such as at idling where a large load output is not demanded, allows for a reduced consumption of lubricating oil and hence for minimization of the generation of smoke or offensive odor.

Furthermore, since the control device 36 according to the embodiment is provided with the injection quantity-controlling means 39*d* as a means for controlling the lubricating oil injected from the injector 46, it is possible, by controlling of the output to the heating element 46*b* of the injector 46, to easily change the quantity of lubricating oil injected upon each injection, thereby making it possible, even at high revolution speeds of the engine 1, to supply a sufficient quantity of lubricating oil which is optimum for the high revolution speed of the engine 1.

Additionally, since the control device 36 according to the embodiment is provided with the injection mode control means 39*c* for controlling the timing (or injection interval) of injecting lubricating oil and also with the injection quantity-controlling means 39*d* for controlling the injection quantity of lubricating oil, it is possible to easily control the timing (or injection interval) of injecting lubricating oil and the adjustment of injection quantity, thus making it possible to minimize any obnoxious components in the exhaust gas.

Inasmuch as the control device 36 according to the invention may be constructed such that the ignition control device 37, the AC power generation means 38 and the lubricating control means 39 are combined into an integral body, the control device 36 can be of small size, thereby making it possible to dispose the control device 36 in the vicinity of the cooling fan-attached rotor 35 and to perform the controlling of the ignition and the injection of lubricating oil by using the single body of control device 36.

While the present invention has been explained based on the foregoing one embodiment, it will be understood that the construction of the device can be varied without departing from the spirit and scope of the invention as claimed in the following claims.

For example, the lubricating oil injection control means of the injector 46 may not be the aforementioned heating element 46*b*, but may be a vibrator, a piezoelectric element or an electromagnetic element.

Also, although the internal combustion engine illustrated in the foregoing embodiment is constructed such that the injector 46 is disposed at a portion of the air-intake system "A" which is located on the upstream side of the intake port formed in the cylinder block, it may be located at any suitable position, such as in a portion of the heat insulator which is located on the upstream side of a reed valve in an internal combustion engine of the type where air-fuel mixture is introduced into the crankcase through the reed valve.

As will be clearly understood from the above explanation, with the separate lubricating device for a two-stroke internal combustion engine of the present invention, since lubricating oil is to be fed by means of electronic control, it is possible to supply the engine with a precisely controlled quantity of lubricating oil, i.e. a larger quantity at high revolution speed of the engine and a smaller quantity at low revolution speed of the engine. Therefore, it becomes possible now to perform a more fine control in supply of lubricating oil as compared with the conventional mechanical pumping system.

Furthermore, since the consumption of lubricating oil can be reduced at a low revolution speed, it is possible to produce a two-stroke internal combustion engine which is capable of inhibiting the generation of smoke or offensive odor, thus protecting the environment.

Inasmuch as the electronic control system provides a large degree of freedom insofar as mounting it on the engine as compared with that of conventional mechanical system, an engine with the mixture method lubrication system can be easily converted into an engine of with a separate lubricating device without requiring the re-designing of parts such as crankshaft, crankcase, etc., i.e. with minimum modification of the parts.

What is claimed:

1. A two-stroke internal combustion engine, comprising an air intake system having an air intake passage, a fuel supply system for supplying fuel to the air intake passage, a controlling device including a fuel control device, and a lubricating device for supplying lubricating oil to the engine separately from the fuel and including an injector for injecting the lubricating oil into the air intake passage, and a lubricating control device associated with the controlling device that controls the timing of the injection of lubricating oil from the injector.

2. The engine according to claim 1, wherein the injector has a heating element for rapidly heating the lubricating oil so as to eject it from the injector.

3. The engine according to claim 1, wherein the lubricating control device includes an injection mode-controller for transforming DC power into a sequential rectangular pulse wave and for varying the number of pulses of the pulse wave output to the injector.

4. The engine according to claim 3, wherein the injection mode-controller provides for selectively switching from an output to the injector of every pulse of the pulse wave to an output to the injector of one pulse out of each consecutive sequence of a selected number of two or more pulses of the pulse wave.

5. The engine according to claim 1, wherein the lubricating control device controls the quantity of lubricating oil injected into the engine from the injector upon each injection by the injector.

6. The engine according to claim 5, wherein the control device controls the quantity of lubricating oil injected into the engine from the injector upon each injection by the injector in response to a signal indicative of the engine load.

7. The engine according to claim 6, wherein the control device controls the quantity of lubricating oil injected into the engine from the injector upon each injection by the injector in response to a signal indicative of the revolution speed of the engine.

8. A two-stroke internal combustion engine, comprising an air intake system having an air intake passage, a fuel supply system for supplying fuel to the air intake passage, a controlling device including a fuel control device, and a lubricating device for supply lubricating oil to the engine separately from the fuel and including an injector for injecting the lubricating oil into the air intake passage, and a lubricating control device associated with the controlling device that controls the timing of the injection of lubricating oil from the injector and the quantity of lubricating oil injected into the engine from the injector upon each injection by the injector.

9. The engine according to claim 8, wherein the injector has a heating element for rapidly heating the lubricating oil so as to eject it from the injector.

10. The engine according to claim 9, wherein the quantity of lubricating oil injected into the engine from the injector upon each injection by the injector is controlled in response to a signal indicative of the engine load.

11. The engine according to claim 10, wherein the quantity of lubricating oil injected into the engine from the injector upon each injection by the injector is controlled in response to a signal indicative of the revolution speed of the internal combustion engine.

12. The engine according to claim 8, wherein the lubricating control device includes an injection mode-controller for transforming DC power into a sequential rectangular pulse wave and for varying the number of pulses of the pulse wave output to the injector.

13. The engine according to claim 12, wherein the injection mode-controller provides for selectively switching from an output to the heating element of every pulse of the pulse wave to an output to the injector of one pulse out of each consecutive sequence of a selected number of two or more pulses of the pulse wave.

* * * * *